US008721227B2

(12) United States Patent
Oldsen et al.

(10) Patent No.: US 8,721,227 B2
(45) Date of Patent: May 13, 2014

(54) YIELDING BOLT AND ASSEMBLY

(75) Inventors: John G. Oldsen, Butler, PA (US); Yaokun Wu, Sudbury (CA); Marc W. Lamothe, Sudbury (CA)

(73) Assignee: FCI Holdings Delaware, Inc., Wilmington, DE (US)

( * ) Notice: Subject to any disclaimer, the term of this patent is extended or adjusted under 35 U.S.C. 154(b) by 256 days.

(21) Appl. No.: 12/873,887

(22) Filed: Sep. 1, 2010

(65) Prior Publication Data

US 2011/0052332 A1 Mar. 3, 2011

Related U.S. Application Data

(60) Provisional application No. 61/238,849, filed on Sep. 1, 2009.

(51) Int. Cl.
*E21D 20/02* (2006.01)

(52) U.S. Cl.
USPC ..... 405/259.1; 405/259.4; 405/259.5; 405/259.6; 405/302.1

(58) Field of Classification Search
USPC ..... 405/259.1, 259.5, 259.6, 302.1, 259.2, 405/259.3, 259.4; 411/82, 82.2, 903
See application file for complete search history.

(56) References Cited

U.S. PATENT DOCUMENTS

| | | | | |
|---|---|---|---|---|
| 3,899,893 | A * | 8/1975 | Banerjee et al. | 405/259.1 |
| 3,940,941 | A * | 3/1976 | Libert et al. | 405/259.6 |
| 4,659,258 | A * | 4/1987 | Scott | 405/259.6 |
| 5,152,649 | A * | 10/1992 | Popp | 411/55 |
| 5,249,898 | A | 10/1993 | Stepanski et al. | |
| 5,344,268 | A | 9/1994 | Fischer | |
| 6,984,091 | B2 | 1/2006 | Maltby | |
| 7,296,950 | B1 | 11/2007 | Stankus et al. | |
| 2009/0136302 | A1 | 5/2009 | Fox | |

FOREIGN PATENT DOCUMENTS

| | | | |
|---|---|---|---|
| EP | 0251887 | A1 | 1/1988 |
| WO | 2006105557 | A1 | 10/2006 |
| WO | 2010078639 | A1 | 7/2010 |

* cited by examiner

*Primary Examiner* — Frederick L Lagman
*Assistant Examiner* — Carib Oquendo
(74) *Attorney, Agent, or Firm* — The Webb Law Firm

(57) ABSTRACT

A mine roof bolt includes an elongated rod and a polymer coating layer. The elongated rod has a first end and a second end with a protruding portion extending radially outward from the elongated rod. The polymer coating layer covers at least a portion of the elongated rod between the first and second ends. The elongated rod is movable relative to the polymer coating layer in an axial direction. The elongated rod has a first position where the elongated rod has a predetermined axial position relative to the polymer coating layer and a second position where the elongated rod has a displaced axial position relative to the first position.

14 Claims, 5 Drawing Sheets

YIELDING BOLT AND ASSEMBLY

CROSS-REFERENCE TO RELATED APPLICATION

This application claims the benefit of U.S. Provisional Application No. 61/238,849, filed Sep. 1, 2009, the entire content of which is hereby incorporated by reference.

BACKGROUND OF THE INVENTION

1. Field of the Invention

The present invention relates to a mine roof bolt anchored in a bore hole by resin bonding, and more particularly to a mine roof bolt bearing a polymer coating layer between a steel bolt and the resin bonding, that yields under loading.

2. Description of Related Art

The roof/ribs of a mine conventionally are supported by tensioning the roof with 4 to 6 foot long steel bolts inserted into bore holes drilled in the mine roof that reinforces the unsupported rock formation above the mine roof. The end of the mine roof bolt may be anchored mechanically to the rock formation by engagement of an expansion assembly on the end of the mine roof bolt with the rock formation. Alternatively, the mine roof bolt may be adhesively bonded to the rock formation with a resin bonding material inserted into the bore hole. A combination of mechanical anchoring and resin bonding can also be employed by using both an expansion assembly and resin bonding material.

A mechanically anchored mine roof bolt typically includes an expansion assembly threaded onto one end of the bolt shaft and a drive head for rotating the bolt. A mine roof plate is positioned between the drive head and the mine roof surface. The expansion assembly generally includes a multi-prong shell supported by a threaded ring and a plug threaded onto the end of the bolt. When the prongs of the shell engage with rock surrounding a bore hole, and the bolt is rotated about its longitudinal axis, the plug threads downwardly on the shaft to expand the shell into tight engagement with the rock thereby placing the bolt in tension between the expansion assembly and the mine roof surface.

When resin bonding material is used, it penetrates the surrounding rock formation to unite the rock strata and to firmly hold the roof bolt within the bore hole. Resin is typically inserted into the mine roof bore hole in the form of a two component plastic cartridge having one component containing a curable resin composition and another component containing a curing agent (catalyst). The two component resin cartridge is inserted into the blind end of the bore hole and the mine roof bolt is inserted into the bore hole such that the end of the mine roof bolt ruptures the two component resin cartridge. Upon rotation of the mine roof bolt about its longitudinal axis, the compartments within the resin cartridge are shredded and the components are mixed. The resin mixture fills the annular area between the bore hole wall and the shaft of the mine roof bolt. The mixed resin cures and binds the mine roof bolt to the surrounding rock.

With certain mining conditions, particularly those found in hard rock mining, the rock formation in the ribs and above the mine roof are susceptible to movement or rock burst as a result of mine-induced seismicity, the excavation of perimeter rock, minor earthquakes, etc. Under dynamic loading caused by rock bursts, the typical mine roof bolts described above are vulnerable to failure. Various mine roof bolts have been designed in an effort to better withstand rock bursts. In particular, mine roof bolts have been designed to yield allowing the bolt to absorb some of the dynamic loading caused by a rock burst. One such design employs a conical-shaped portion at the far end of the bolt, which is designed to pull through the resin or grout in response to excessive forces applied to the bolt. A further design, as disclosed in U.S. Pat. No. 6,984,091, utilizes a bolt having a widened portion of the bolt shaft that is pulled through a longitudinal bore of an anchor member secured within the bore'hole.

SUMMARY OF THE INVENTION

In one embodiment, a mine roof bolt includes an elongated rod and a polymer coating layer. The elongated rod has a first end and a second end. A protruding portion extends radially outward from the elongated rod. The polymer coating layer covers at least a portion of the elongated rod between the first and second ends. The elongated rod is movable relative to the polymer coating layer in an axial direction. The elongated rod has a first position where the elongated rod has a predetermined axial position relative to the polymer coating layer and a second position where the elongated rod has a displaced axial position relative to the first position.

The polymer coating layer may comprise a polymeric material and the polymer coating layer may cover the protruding portion of the elongated rod. The protruding portion may be positioned adjacent to the second end of the elongated rod. The polymer coating layer may have a first thickness at the protruding portion and a second thickness at a remaining portion of the elongated rod. The first thickness may be smaller than the second thickness. The protruding portion may be integral with the elongated rod. A transition between the protruding portion and the elongated rod may include a radiused portion. The first end of the elongated rod may include a threaded portion and a drive nut may be positioned on the threaded portion. The first end of the elongated rod may include a drive head and the drive head may be integral with the elongated rod.

In a further embodiment, a method of supporting a mine roof includes inserting a frangible resin cartridge into a bore hole formed in the mine roof, and positioning a mine roof bolt in the bore hole. The mine roof bolt includes an elongated rod having a first end and a second end. A protruding portion extends radially outward from the elongated rod, and a polymer coating layer covers at least a portion of the elongated rod between the first and second ends. The protruding portion includes an outer threaded surface. The method further includes rupturing the resin cartridge, rotating the mine roof bolt about a longitudinal axis of the elongated rod in a first direction to mix contents of the resin cartridge, and rotating the mine roof bolt about the longitudinal axis in a second direction to tension the mine roof bolt.

The mine roof bolt may be rotated in the first and second directions via a drive head. The elongated rod may be axially displaced relative to the polymer coating layer during rotation of the mine roof bolt in the second direction. The elongated rod may rotate relative to the polymer coating layer during rotation of the mine roof bolt in the first and second directions. The elongated rod may be restricted from axial movement relative to the polymer coating layer during rotation of the mine roof bolt in the first direction via engagement of the protruding portion with the polymer coating layer. The outer threaded surface of the protruding portion may engage the polymer coating layer to cause the axial displacement of the elongated rod relative to the polymer coating layer. The drive head may be formed integrally with the elongated rod and the polymer coating layer may be anchored within the bore hole after mixing the contents of the resin cartridge and upon curing of the contents of the resin cartridge.

DESCRIPTION OF THE PREFERRED EMBODIMENTS

Figure 1:
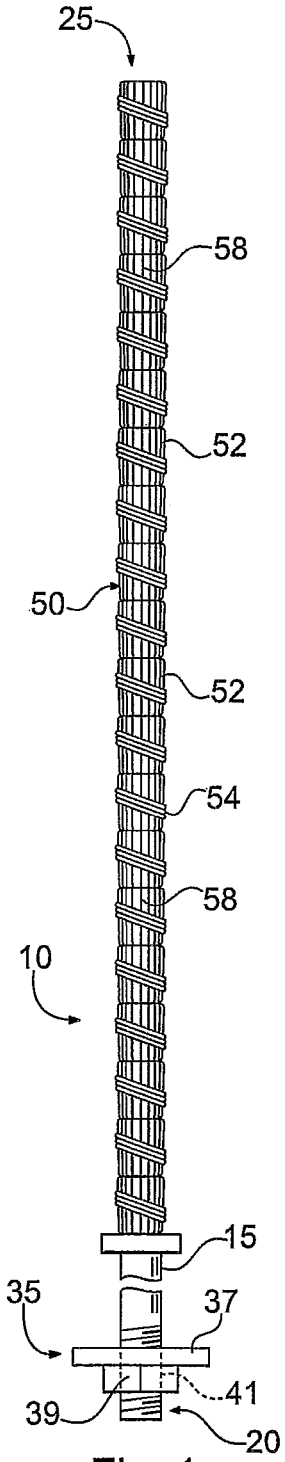
FIG. 1 is a side elevational view of a mine roof bolt according to one embodiment of the present invention.

The present invention will now be described with reference to the accompanying figures. For purposes of the description hereinafter, the terms "upper", "lower", "right", "left", "vertical", "horizontal", "top", "bottom," and derivatives thereof shall relate to the invention as it is oriented in the drawing figures. However, it is to be understood that the invention may assume various alternative variations and step sequences, except where expressly specified to the contrary. It is to be understood that the specific apparatus illustrated in the attached figures and described in the following specification is simply an exemplary embodiment of the present invention. Hence, specific dimensions and other physical characteristics related to the embodiments disclosed herein are not to be considered as limiting.

Figure 2:
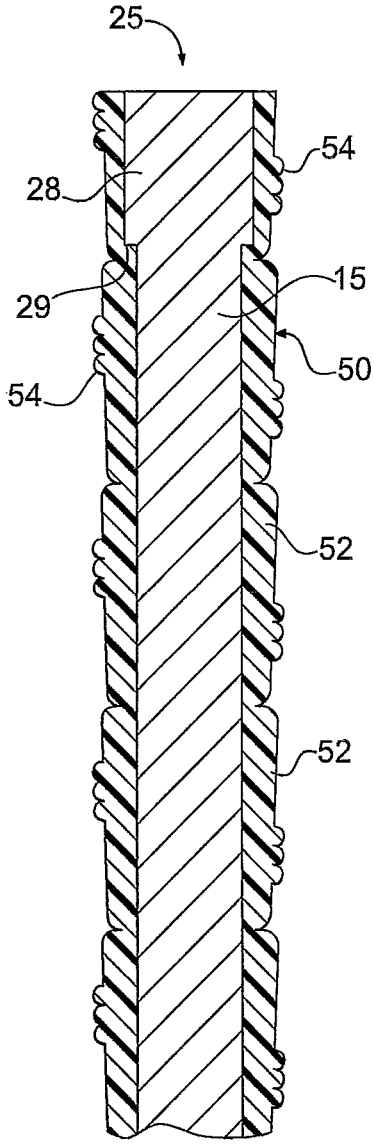
FIG. 2 is a partial cross-sectional view of the bolt shown in FIG. 1.
Figure 3:
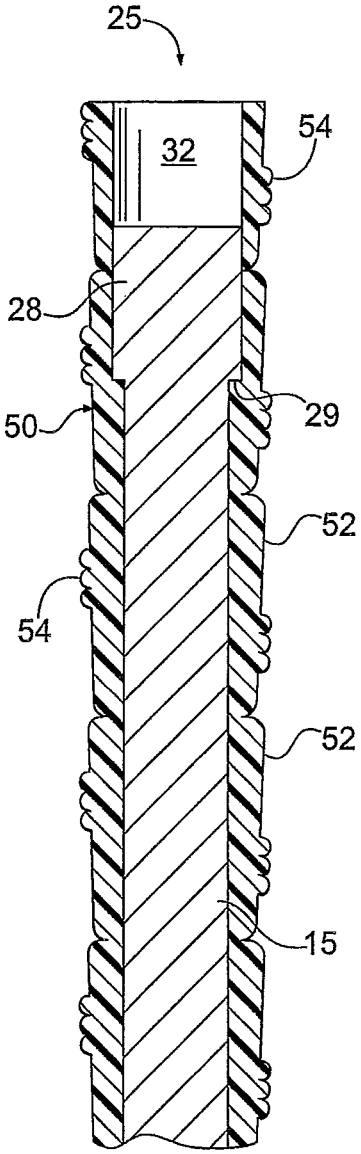
FIG. 3 is a partial cross-sectional view of the bolt shown in FIG. 1, showing the bolt in a displaced or yielded position.
Figure 4:
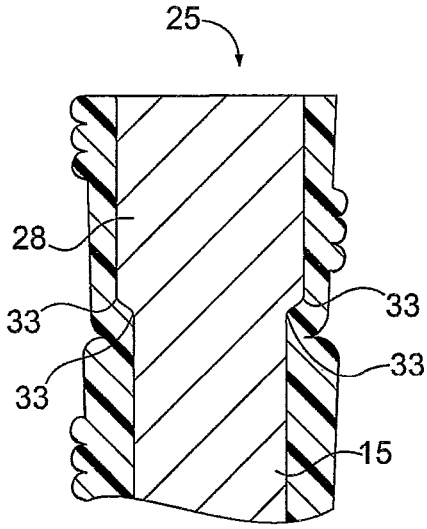
FIG. 4 is a partial cross-sectional view of the bolt shown in FIG. 1, showing an alternative embodiment of an insertion end.

Referring to FIGS. 1-3, one embodiment of a mine roof bolt 10 is disclosed. The mine roof bolt 10 includes an elongated rod 15 having a threaded drive end 20 and an insertion end 25. A drive nut 35 is threaded onto the threaded drive end 20. The drive nut 35 generally includes a shoulder 37, a plurality of drive faces 39, and a threaded inner surface 41 to receive the threaded drive end 20 of the elongated rod 15. The drive nut 35 extends in a direction opposite from the insertion end 25. The insertion end 25 includes a protruding portion 28 that extends radially outward from the elongated rod 15. A bottom edge 29 of the protruding portion 28 as well as the transition between the protruding portion 28 and the elongated rod 15 may be sharp, i.e., having a 90 degree angle, or may include a rounded or radiused edge. In particular, as shown in FIG. 4, one embodiment of the protruding portion 28 of the insertion end 25 includes radiused portions 33 at the bottom of the protruding portion 28 as well as at the transition between the protruding portion 28 and the elongated rod 15. The protruding portion 28 may be formed by cold or hot forging, by machining, or any other suitable process. As shown in FIG. 2, for example, the protruding portion 28 is formed integrally with the elongated rod 15.

The mine roof bolt 10 includes a polymer coating layer 50 having a plurality of tapered segments 52. The polymer coating layer 50 extends from an intermediate position of the elongated rod 15 to the insertion end 25. The mine roof bolt 10 may include a resin retaining ring 45 disposed over the elongated rod 15. The elongated rod 15 may have a length of 6 to 13 feet and the threaded drive end 20 may be 3 to 6 inches. Further, the polymer coating layer 50 may have a length of 6 feet and the protruding portion 28 of the insertion end 25 may have a length of 1.25 inches. Other lengths of the elongated rod 15, drive end 20, protruding portion 28, and polymer coating layer 50, however, may be selected depending on roof anchoring needs. The elongated rod 15 may be a smooth rod made from 0.680 inch steel round bar and the protruding portion 28 may have a diameter of 0.800 to 0.850 inches, although other suitable size diameters may be used for the elongated rod 15 and protruding portion 28. The polymer coating layer 50 may be produced from plastic, such as nylon, polycarbonate, or polyethylene terephthalate (PET), although other suitable material may be used provided the material functions during impact loading as described below. In a particular embodiment, the polymer coating layer 50 is 13% glass-filled nylon, although other percentages of glass-filled nylon may be used.

As discussed in more detail below, the elongated rod 15 is movable relative to the polymer coating layer 50 in an axial direction, i.e., along a longitudinal axis of the elongated rod 15 extending between the drive end 20 and the insertion end 25. The elongated rod 15 has a first position (such as that shown in FIG. 2) where the elongated rod 15 has a predetermined axial position relative to the polymer coating layer 50 and a second position (such as that shown in FIG. 3) where the elongated rod 15 has a displaced axial position relative to the first position. Further, as shown in FIG. 2, the polymer coating layer 50 has a first thickness at the protruding portion 28 and a second thickness at the remaining portion of the elongated rod 15. In particular, the first thickness of the coating layer 50 at the protruding portion 28 is thinner than at the second thickness of the coating layer 50 that extends, for example, to the portions of the elongated rod 15 not having the protruding portion 28. Thus, due to the protruding portion 28 of the rod 15, the polymer coating layer 50 will have at least a first inner diameter dimension and a second inner diameter dimension that defines a step or transition therebetween.

The mine roof bolt 10 may be produced by coating the elongated rod 15 with a flowable polymer so that the coating has a thickness of, for example, about at least 1 mm. The polymer is allowed to solidify on the elongated rod 15 and texturing is applied to the exterior of the polymer to form spiral threads 54 and ridges 58. The coating step may be performed by dip coating, injection molding, and/or hot forging of the polymer resulting in an outer layer of a low density hard coating of the polymer coating layer 50 on an inner portion of higher density material (e.g., steel) of the elongated rod 15. Suitable polymer and methods of applying polymer coating layers 50 are described in U.S. Pat. No. 7,296,950 to Stankus et al, incorporated herein by reference in its entirety.

Figure 5:
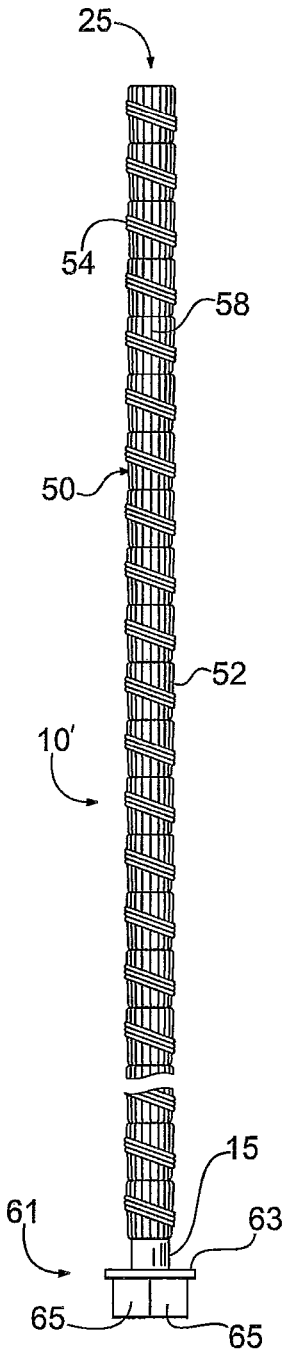
FIG. 5 is a side elevational view of a mine roof bolt according to a further embodiment of the present invention.
Figure 6:
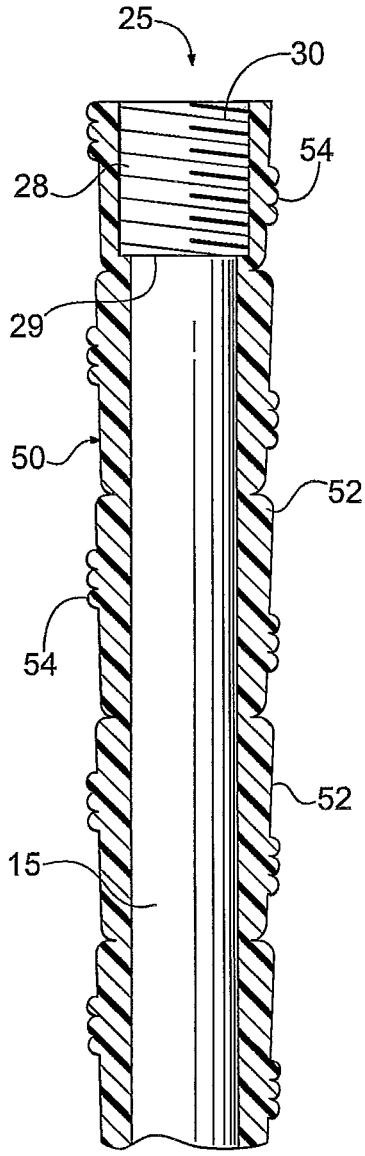
FIG. 6 is a partial cross-sectional view of the bolt shown in FIG. 5, showing a section of a polymer coating layer and a threaded outer surface of an elongated rod.

Referring to FIGS. 5 and 6, a mine roof bolt 10' according to a further embodiment is disclosed. The mine roof bolt 10' is similar to the bolt shown in FIGS. 1-3, but instead of a threaded drive end 20 and drive nut 35, the bolt 10' includes a drive head 61 having a shoulder 63 and a plurality of drive faces 65. As shown in FIG. 5, the drive head 61 is formed integrally with the elongated rod 15, although other suitable drive head 61 arrangements may be utilized. Further, the protruding portion 28 of the insertion end 25 has an outer threaded surface 30 as shown in FIG. 6. The mine roof bolt 10' also includes a polymer coating layer 50 that extends from the drive head 61 to the insertion end 25 and covers the outer threaded surface 30 of the protruding portion 28. The polymer coating layer 50, however, may only extend from an intermediate portion of the elongated rod 15 to the insertion end 25.

Figure 7:
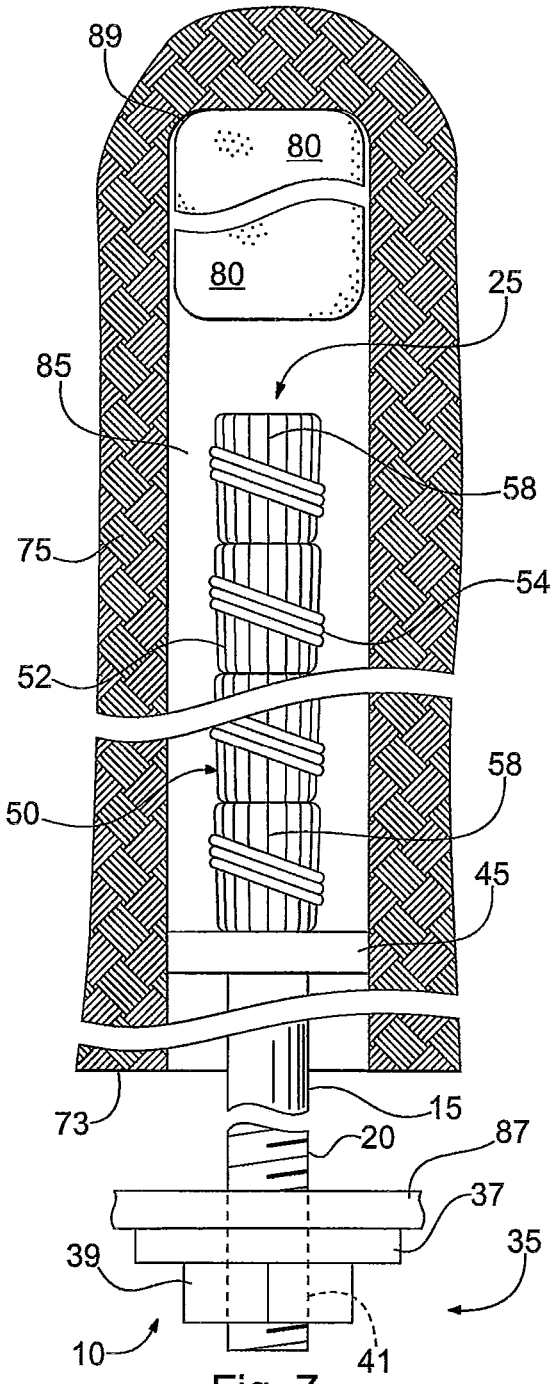
FIG. 7 is a side elevational view of the bolt of FIG. 1, showing the bolt being installed into a bore hole.
Figure 8:
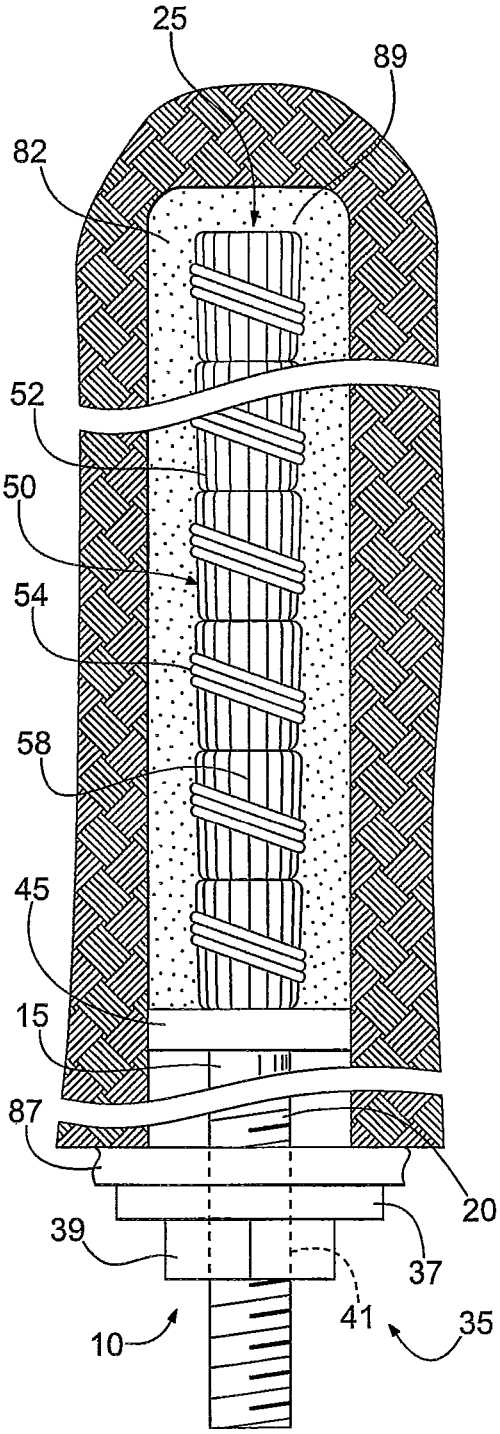
FIG. 8 is a side elevational view of the bolt of FIG. 1, showing the bolt installed in a bore hole.

Referring to FIGS. 7 and 8, the mine roof bolt 10 may be installed in a mine roof 73 to provide support to a rock formation 75. In one embodiment, the mine roof bolt 10 is installed by inserting a frangible resin cartridge 80 into a bore hole 85 and inserting the mine roof bolt 10 into the bore hole 85. The drive nut 35 is threaded onto the threaded drive end 20 of the elongated rod 15 until the drive nut 35 cannot be advanced further along the threaded drive end 20 when the drive nut 35 abuts a stop (not shown) or the mine roof 73 itself. Further, a bearing plate 87 is provided between the shoulder 37 of the drive nut 35 and the mine roof 73. Continued rotation of the drive nut 35 imparts rotation to the mine roof bolt 10. When the insertion end 25 of the mine roof bolt 10 contacts the resin cartridge 80, the insertion end 25 contacts and ruptures the resin cartridge 80 thereby releasing a curable resin 82. The insertion end 25 may also include a puncturing portion (not shown) to assist in rupturing the resin cartridge 80. The mine roof bolt 10 is rotated about its longitudinal axis so that the polymer coating layer 50 and any exposed portion of the elongated rod 15 mixes the contents of the resin cartridge 80. As shown in FIG. 8, the resin retaining ring 45 impedes the flow of resin 82 towards the threaded drive end 20 of the elongated rod 15. Upon curing of the resin 82, the mine roof bolt 10 is securely anchored within the bore hole 85.

Figure 9:
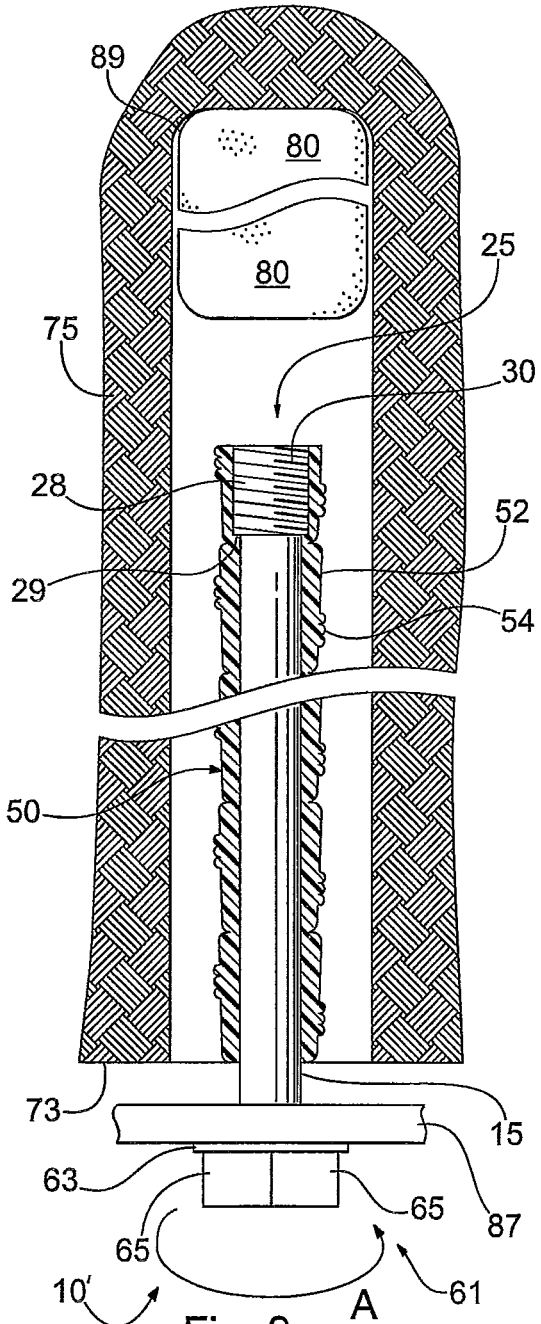
FIG. 9 is a side elevational view of the bolt of FIG. 5, showing the bolt being installed into a bore hole.
Figure 10:
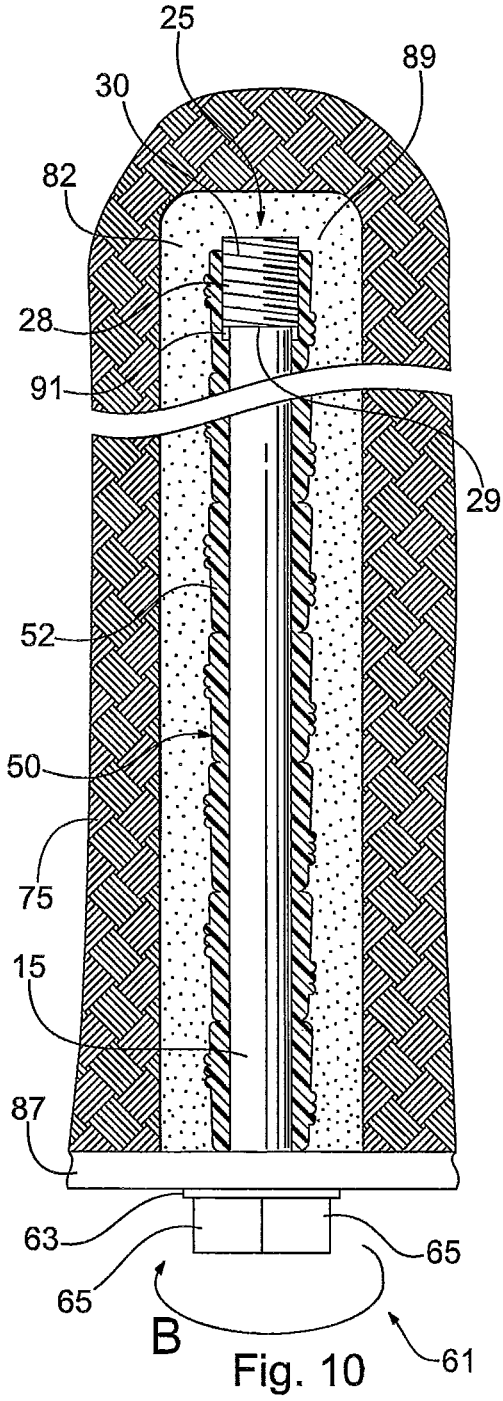
FIG. 10 is a side elevational view of the bolt of FIG. 5, showing the bolt installed in a bore hole.

Referring to FIGS. 9 and 10, the mine roof bolt 10' shown in FIGS. 5 and 6 may be installed in a mine roof in a similar manner described above and shown in FIGS. 7 and 8 with respect to the mine roof bolt 10. The mine roof bolt 10' is installed by inserting a frangible resin cartridge 80 into a bore hole 85 and inserting the mine roof bolt 10' into the bore hole 85 to contact and rupture the cartridge 80. The mine roof bolt 10' is rotated in a first direction A, shown in FIG. 9, about its longitudinal axis by engaging the drive faces 65 of the drive head 61 with a drive tool (not shown). Due to the difference between the inner diameter of the polymer coating layer 50 at the protruding portion 28 and the rest of the elongated rod 15, the rod 15 will be prevented from displacing within the coating layer 50 towards the open end of the bore hole 85 during rotation of the bolt 10' in the first direction A. After a period of time to allow the resin 82 from the cartridge 80 to set up properly, the bolt 10' is rotated in a second direction B (opposite from the first direction), shown in FIG. 10, to apply a torque and tension to the bolt pursuant to a mine roof control plan. The rod 15 is displaced toward the blind end 89 of the bore hole 85 when rotated in the second direction B, because the protruding portion 28 is not restricted by a smaller diameter portion of the polymer coating layer 50. In other words, the polymer coating layer 50 of the bolt 10' is securely anchored within the bore hole and the elongated rod 15 is displaced within the polymer coating layer 50 toward the blind end of the bore hole through the engagement of the outer threaded surface 30 of the protruding portion 28 with the anchored polymer coating layer 50. The displacement of the elongated rod 15 within the coating layer 50 forms a space 91 defined by the coating layer 50 and the bottom edge 29 of the protruding portion 28 of the rod 15. Accordingly, the bolt 10' may be tensioned such that the bottom of the elongated rod 15 does not protrude through the drive head 61 of the bolt 10' and further into the mine opening. Minimizing the distance that the bolt 10' extends into the mine opening improves clearance in the opening and reduces the risk of accidental contact with the drive end of the bolt 10'.

With respect to the mine roof bolts 10, 10' discussed above, the polymer coating layer 50 serves several functions during installation and after the bolt 10, 10' is installed in the mine roof 73. As the bolt 10, 10' is rotated about its longitudinal axis, the spiral threads 54 on the polymer coating layer 50 urge resin 82 upwardly toward the blind end 89 of the bore hole 85. Retention of resin 82 at the blind end 89 of the bore hole 85 is desired to ensure good bonding between the mine roof bolts 10, 10' and the surrounding rock and to concentrate the anchoring function at the insertion end 25 of the bolt 10, 10'. Sufficient resin 82 is required in the annulus between the mine roof bolt 10, 10' and the bore hole wall to completely fill the annulus and allow for some of the resin 82 to fill cracks and crevices in the rock to enhance the interlock between the rock and the mine roof bolt 10, 10'. In addition, bolts that are anchored via resin bonding create a "point anchor" that permits tensioning of the bolt between the resin point anchor and the mine roof surface. Retention of the resin 82 at the upper end of the bolt 10, 10' allows a point anchor system that is tensionable. The polymer coating layer 50 also serves to mix the resin 82. The spiral threads 54 and the ridges 58 provide mixing surfaces to enhance mixing of the curable resin 82. The segmented arrangement of the polymer coating layer 50 also provides surface disruptions that enhance mixing and improve anchorage. To improve the centering of the bolt with the polymer coating layer 50, small projections (not shown) of 1-2 mm every 75-100 mm of longitudinal length and at 90 degree arc spacing may be formed on the outer surface of the polymer coating layer 50. These projections also aid in the rupturing of the resin cartridge film and mixing of the two resin components.

During impact or dynamic loading, particularly during an impact load of 8-10 tons, the elongated rod 15 pulls through and is displaced relative to the polymer coating layer 50, which remains anchored within the bore hole 85 via the resin 82. As shown more clearly in FIG. 3, the protruding portion 28 of the insertion end 25 pulls through the polymer coating layer 50 in a longitudinal direction leaving behind a cavity 32 where the protruding portion 28 was previously positioned. A portion of the elongated rod 15 may be coated with a mold release agent to assist in the displacement of the elongated rod 15 within the polymer coating layer 50. The mold release agent may be zinc stearate, polytetrafluoroethylene, or any other suitable agent. The impact loading generates a complex interaction between the protruding portion 28 and the polymer coating layer 50 including confined compression and deformation of the polymer coating layer 50 by the protruding portion 28. The confined compression and deformation of the polymer coating layer 50 by the protruding portion 28 absorbs the impact energy in a controlled method over the longitudinal displacement of the protruding portion 28 through the polymer coating layer 50. Compression and frictional heating generated by the impact loading and the engagement of the protruding portion 28 with the polymer coating layer 50 cause the polymer coating layer 50 to soften and become flowable immediately at and behind the protruding portion 28 as it is displaced through the polymer coating layer 50. Further, during displacement of the elongated rod 15 with the protruding portion 28, the polymer coating layer 50 protrudes in a radial outward direction such that the resin 82 in the annulus between the polymer coating layer 50 and the bore hole 85 is compressed, which may result in deformation and powdering of the resin 82. Further, although the mine roof bolts 10, 10' are shown to have the polymer coating layer 50 entirely covering the protruding portion 28, the polymer coating layer 50 may only extend up to the protruding portion 28 such that the protruding portion 28 is not covered by the polymer coating layer 50. The protruding portion 28 also may only be partially covered by the polymer coating layer 50. In such arrangements, the mine roof bolts 10, 10' would perform in the same manner described above by engaging and pulling through polymer coating layer 50 in a longitudinal direction. Moreover, although the mine roof bolts 10, 10' are described above in relation to an impact loading situation, the mine roof bolts 10, 10' may also be used in mines that experience convergence. In particular, during convergence loading, the protruding portion 28 of the insertion end 25 pulls through the polymer coating layer 50 in a longitudinal direction in a similar manner described above in relation to impact loading.

Accordingly, the mine roof bolts 10, 10' yield under an impact load to absorb energy and reduce the likelihood of an immediate failure of the mine roof bolts 10, 10'. The movement of the elongated rod 15 within the polymer coating layer 50 also provides an indication of an unstable roof condition so that workers in the area may reinforce the roof or evacuate. Typically, after experiencing a shift in rock strata or other seismic event, the roof in the area of the shift will be re-bolted or reinforced in some other manner. The dimensions of the protruding portion 28 of the insertion end 25 may be selected to control the amount of yielding or displacement of the elongated rod 15 within the polymer coating layer 50. Although the mine roof bolts 10, 10' are shown to be centered within the bore hole 85 and the protruding portion 28 is concentric with the elongated body 15, the bolts 10, 10' may be positioned off center in the bore hole 85 and the protruding portion 28 may be non-concentric with elongated rod 15. The bolts 10, 10' generally experience consistent displacement of the elongated rod 15 within the polymer coating layer 50 upon initial and subsequent dynamic loads. Further, the mine roof bolts 10, 10' also typically have low bolt stretch or plastic deformation relative to the movement of the anchorage, i.e., the movement of the elongated rod 15 within the polymer coating layer 50. For instance, upon second and third cycles of dynamic loading, the bolts 10, 10' generally have consistent anchorage movement while having relatively low plastic deformation of the bolts 10, 10'.

A laboratory pull was conducted to determine the performance of the mine roof bolts 10, 10' of the present invention. The test was designed to determine the degree of displacement (length) that a bolt produced according to the present invention will exhibit upon receiving a load. The test was performed with a 0.680 inch smooth bar as the elongated rod 15 with a 0.850 inch diameter protruding portion 28. The length of the bolt 10 tested was 26.125 inches in length and the protruding portion 28 was 1.25 inches in length. The polymer coating layer 50 was a polycarbonate coating with a mold release agent applied to the elongated rod 15. The bolt 10 was installed in a 35 mm diameter steel tube with an outer diameter of 1.875 inches. Original embodiment length was 15 inches in the tube with 18 inches having the polymer coating layer 50. As load was added to the free end of the bolt 10, the displacement of the bolt 10 was measured. The bolt 10 was displaced approximately 20 mm at a load of 11 tons and approximately 40 mm at a load of 16 tons. The final load was 19.5 tons and the final length of the bolt 10 was 27.125 inches. The anchorage movement was approximately 3.750 inches. The bolt 10 generally experienced consistent anchorage movement.

While several embodiments of the point anchor yielding bolt were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A mine roof bolt comprising:

an elongated rod having a first end and a second end;

a protruding portion extending radially outward from the elongated rod; and a polymer coating layer covering the protruding portion and at least a portion of the elongated rod between the first and second end, the polymer coating layer comprising a plurality of tapered segments, the polymer coating layer having a first end positioned adjacent the protruding portion and a second end positioned opposite the first end of the polymer coating layer, the polymer coating layer comprising a polymeric material and having a first thickness at the protruding portion and a second thickness at a remaining portion of the elongated rod, wherein the elongated rod has a first position where the elongated rod has a predetermined axial position relative to the polymer coating layer and a second position where the elongated rod has a displaced axial position relative to the first position, the elongated rod is movable relative to the polymer coating layer from the first position to the second position in a direction extending from the first end of the polymer coating toward the second end of the polymer coating, the protruding portion and the elongated rod defining a transition between the protruding portion and the elongated rod, the transition including one of a radiused portion and a planar portion that defines a 90 degree angle between the transition and the elongated rod, and wherein, after installation, the protruding portion is configured to pull through the polymer coating layer with the elongated rod configured to move from the first position to the second position in response to dynamic loading of the mine roof bolt to absorb the dynamic loading in a controlled manner.

2. The mine roof bolt of claim 1, wherein the protruding portion is positioned adjacent to the second end of the elongated rod.

3. The mine roof bolt of claim 1, wherein the first thickness is smaller than the second thickness.

4. The mine roof bolt of claim 1, wherein the protruding portion is integral with the elongated rod.

5. The mine roof bolt of claim 1, wherein the first end of the elongated rod includes a threaded portion, and wherein a drive nut is positioned on the threaded portion.

6. The mine roof bolt of claim 1, wherein the first end of the elongated rod includes a drive head.

7. The mine roof bolt of claim 6, wherein the drive head is integral with the elongated rod.

8. The mine roof bolt of claim 1, wherein the protruding portion has a diameter of about 20.32 mm to 21.59 mm.

9. A method of supporting a mine roof comprising:

inserting a frangible resin cartridge into a bore hole formed in the mine roof;

positioning a mine roof bolt in the bore hole, the mine roof bolt comprising:

an elongated rod having a first end and a second end;

a protruding portion extending radially outward from the elongated rod; and a polymer coating layer covering at least a portion of the elongated rod between the first and second ends, wherein the protruding portion includes an outer threaded surface;

rupturing the resin cartridge;

rotating the mine roof bolt about a longitudinal axis of the elongated rod in a first direction to mix contents of the resin cartridge; and rotating the mine roof bolt about the longitudinal axis in a second direction to tension the mine roof bolt, wherein the elongated rod is restricted from axial movement relative to the polymer coating layer during rotation of the mine roof bolt in the first direction via engagement of the protruding portion with the polymer coating layer.

10. The method of claim9, wherein the mine roof bolt is rotated in the first and second directions via a drive head.

11. The method of claim 10, wherein the elongated rod is axially displaced relative to the polymer coating layer during rotation of the mine roof bolt in the second direction.

12. The method of claim 11, wherein the drive head is formed integrally with the elongated rod.

13. The method of claim 11, wherein the outer threaded surface of the protruding portion engages the polymer coating layer to cause the axial displacement of the elongated rod relative to the polymer coating layer.

14. The method of claim 10, wherein the polymer coating layer is anchored within the bore hole after mixing the contents of the resin cartridge and upon curing of the contents of the resin cartridge.

* * * * *